US007316516B2

(12) United States Patent
Regala

(10) Patent No.: US 7,316,516 B2
(45) Date of Patent: Jan. 8, 2008

(54) POCKETABLE WRITING INSTRUMENT

(75) Inventor: Alan C. Regala, Mountain View, CA (US)

(73) Assignee: Everyday Innovations Inc., Mountain View, CA (US)

( * ) Notice: Subject to any disclaimer, the term of this patent is extended or adjusted under 35 U.S.C. 154(b) by 0 days.

(21) Appl. No.: 11/120,021

(22) Filed: May 2, 2005

(65) Prior Publication Data

US 2006/0204312 A1 Sep. 14, 2006

Related U.S. Application Data

(63) Continuation-in-part of application No. 11/074,624, filed on Mar. 8, 2005.

(51) Int. Cl.
*A46B 5/02* (2006.01)
*A46B 11/00* (2006.01)

(52) U.S. Cl. ..... 401/6; 401/48; 401/131

(58) Field of Classification Search ..... 401/6–8, 401/48, 52, 88, 195, 95, 131; 15/443; 16/421, 16/430; 81/489
See application file for complete search history.

(56) References Cited

U.S. PATENT DOCUMENTS

| | | | | |
|---|---|---|---|---|
| 303,346 | A | 8/1884 | Vernone | |
| D18,482 | S | 7/1888 | Shattuck | |
| 564,178 | A * | 7/1896 | Ahrens | 15/443 |
| 780,599 | A | 1/1905 | Cypert | |
| 1,407,239 | A | 2/1922 | Weiss | |
| 2,520,176 | A | 8/1950 | Stanley | |
| 2,765,015 | A | 10/1956 | Lupfer et al. | |
| 2,845,047 | A | 7/1958 | McKendree | |
| 3,168,072 | A | 2/1965 | Nitta | |
| 3,174,461 | A * | 3/1965 | Pompa | 401/210 |
| 3,250,255 | A * | 5/1966 | Cruickshank | 248/118.5 |
| 3,947,977 | A | 4/1976 | Bishop | |
| 3,994,605 | A | 11/1976 | McKnight | |
| 4,076,427 | A | 2/1978 | Anderson | |
| 4,391,457 | A | 7/1983 | Gassner | |
| 4,395,056 | A | 7/1983 | Sferragatta | |
| 4,568,213 | A | 2/1986 | Money | |
| 4,678,206 | A | 7/1987 | Leahan | |
| 4,689,020 | A | 8/1987 | Rusk | |

(Continued)

OTHER PUBLICATIONS

United States Additional Improvements Patent No. 120, dated Apr. 10, 1855.*

(Continued)

*Primary Examiner*—Khoa D. Huynh
(74) *Attorney, Agent, or Firm*—Fliesler Meyer LLP

(57) ABSTRACT

A pocketable writing instrument includes an elongate body which incorporates a flexible dual tab grip 66. The grip provides the user with additional surface area with which to grip the instrument during writing; this allows the device to be comfortable during use yet small and compact during storage. When used in conjunction with a pocketable note holder, the grip also performs additional functions: it provides an axial stop for the instrument such that it can be repeatedly placed in the same position within the holder (preventing instrument protrusion from the device); and it allows the user to easily insert and remove the instrument from the receptacle, whereas this action might otherwise be awkward with a traditional small elongate object. This abstract description is not intended to be a complete description of, or limit the scope of, the invention.

16 Claims, 11 Drawing Sheets

U.S. PATENT DOCUMENTS

| | | | | |
|---|---|---|---|---|
| 4,732,504 | A | | 3/1988 | Telli |
| 4,815,880 | A | | 3/1989 | Sekiguchi |
| 4,963,048 | A | | 10/1990 | Thomas et al. |
| 4,991,985 | A | | 2/1991 | Laipply |
| 5,029,899 | A | | 7/1991 | Schieppati et al. |
| 5,029,903 | A | | 7/1991 | Pennock |
| 5,056,945 | A | | 10/1991 | Klodt |
| 5,061,104 | A | | 10/1991 | Florjancic |
| 5,143,463 | A | | 9/1992 | Pozil et al. |
| 5,158,205 | A | | 10/1992 | Bodziak et al. |
| 5,170,889 | A | | 12/1992 | Cue |
| 5,203,457 | A | | 4/1993 | Garcia |
| 5,332,324 | A | | 7/1994 | Hochstetler |
| 5,468,083 | A | | 11/1995 | Chesar |
| 5,480,037 | A | | 1/1996 | Pope |
| 5,498,089 | A | | 3/1996 | Motyka |
| 5,678,939 | A | | 10/1997 | Ross |
| 5,713,406 | A | | 2/1998 | Drury |
| 5,722,575 | A | * | 3/1998 | Smith ..... 224/217 |
| 5,769,213 | A | | 6/1998 | Chatterton |
| 5,813,786 | A | | 9/1998 | Fraenkel |
| 5,897,261 | A | | 4/1999 | Goetz |
| 5,988,909 | A | | 11/1999 | Luke, Jr. et al. |
| 5,988,918 | A | | 11/1999 | Johnson |
| 6,019,534 | A | | 2/2000 | Heins |
| 6,062,753 | A | | 5/2000 | Hadtke et al. |
| 6,247,864 | B1 | | 6/2001 | Walsh |
| 6,343,885 | B1 | | 2/2002 | Heyne |
| 6,379,068 | B1 | | 4/2002 | Yu |
| 6,464,419 | B1 | | 10/2002 | Chan |
| 6,554,515 | B2 | | 4/2003 | Debbas |
| 6,554,519 | B1 | | 4/2003 | Kaplan |
| 6,648,536 | B1 | | 11/2003 | Bellue |
| 6,702,496 | B1 | | 3/2004 | Park |
| 6,779,937 | B1 | | 8/2004 | Lombardi et al. |
| 6,808,104 | B2 | | 10/2004 | Cobble |
| 6,811,025 | B1 | | 11/2004 | Kaplan |
| 6,819,557 | B2 | | 11/2004 | Lilenfeld |
| 2004/0265039 | A1 | * | 12/2004 | Buck ..... 401/195 |

OTHER PUBLICATIONS

Kangaroo Memo Book with flat pen and special pocket advertisement, at least before May 2, 2005.

Victorinox Swiss Army writing instrument with pocket advertisement, at least before May 2, 2005.

* cited by examiner

POCKETABLE WRITING INSTRUMENT

PRIORITY CLAIM

This application is a continuation-in-part of U.S. patent application Ser. No. 11/074,624, filed Mar. 8, 2005, entitled POCKETABLE NOTE HOLDER WITH WRITING INSTRUMENT, which is incorporated herein by reference.

FIELD OF INVENTION

This invention relates to writing instruments, and in specific embodiments, to such writing instruments which may be contained in a notepad holder.

BACKGROUND OF THE INVENTION

People often find the need to capture random thoughts throughout the day, wherever they may be. Without an appropriate capturing device at their disposal, these thoughts can be forgotten or remembered too late.

The simplest solution to this unfulfilled need of on-the-go note taking combines a notepad and a writing instrument in one convenient package. Examples of prior art include paper-holding pens such as U.S. Pat. No. 4,872,775 to Chang (1989), U.S. Pat. No. 4,963,048 to Thomas et al. (1990), and U.S. Pat. No. 6,247,864 to Walsh (2001).

Each of these references discloses a conventional-sized pen, approximately 6 inches in length, which contain a roll of note papers within the body of the pen. Two distinct disadvantages of this type of solution are 1) not having an included surface onto which one can lay the note and write and 2) having to carry a standard-sized pen, which is not convenient in some circumstances.

Different types of notepad holders with writing instruments have been proposed, but each has its limitations. Two examples of prior art include U.S. Pat. No. 4,391,457 (1983) to Gassner and U.S. Pat. No. 6,554,519 to Kaplan (2003). Gassner's invention contains a notepad within a flexible folded holder, and the writing instrument is attached by means of a pen clip to the outside edge of the holder. Kaplan's invention contains several plastic components, which make up a rigid notepad case with an integrated pen. Both of these designs suffer from a number of disadvantages:

a) Both devices are somewhat bulky. If one were to store either one of these in his pocket, the large size would compete for pocket space with other items such as a phone, wallet, and keys. Similarly, either device would consume a large amount of real estate in a purse or bag. Neither design lends itself to being thin enough to fit into small spaces, such as the credit card sleeve of a wallet.

b) Both housings contain multiple components, including plastic parts. The materials and number of components make the manufacturing of these devices relatively expensive.

c) In Kaplan's design, the integrated pen is not conducive to being user-friendly. In order to write a note, one must first remove a note (or entire notepad) from the device and grip the entire case in one's hand to use the pen. Not only is writing awkward and unintuitive, but one cannot use the case as a writing surface concurrently because the case is rigidly attached to the pen.

Another example of prior art is U.S. Pat. No. 5,769,213 (1998) to Chatterton. This device is comprised of a rigid plastic credit card-sized holder, which holds a small custom pen. This invention has several distinct disadvantages:

a) The device is made of plastic, which requires expensive capital tooling, and the material cost is high compared to that of paper.

b) The device needs adequate wall thickness, about 0.040", to maintain a rigid form. This increases the overall thickness of the device, especially around the pen. In contrast, sturdy paper is as thin as 0.010".

c) The rigidity of such a device in a wallet sleeve would make the entire wallet more rigid. Since many wallet-carrying people, particularly males, hold their wallets in a pants pocket, the wallet would be less likely to deform and adapt to varying loads (i.e. sitting on it in a back pocket), making it uncomfortable.

d) The printable space on the device is limited. Since the pen receptacle protrudes from the base section, it is more difficult and expensive to print on the surface of this base section.

Accordingly, it would be advantageous to provide a notepad holder with writing instrument which is practical and convenient, which is easily stored in a pocket, purse, wallet, or other small space, which is simple and easy to use, which is inexpensive to manufacture, and which will present a large surface for the reception of graphics, including company logos, business card information, artwork, comics, text, etc.

SUMMARY

In accordance with an embodiment of the present invention, a pocketable writing instrument includes a thin elongate shaft which is small in diameter for easy storage in small spaces but still comfortable to use due to stabilizing tabs on the shaft of the instrument. Embodiments of the present invention are also directed to a notepad holder which may store the writing instrument therein.

This description is not intended to be a complete description of, or limit the scope of, the invention. Other features, aspects, and objects of the invention can be obtained from a review of the specification, the figures, and the claims.

DRAWING FIGURES

In the drawings, closely related figures have the same number but different alphabetic suffixes. The distinctions between figures with different alphabetic suffixes are readily understandable.

DRAWINGS—REFERENCE NUMERALS

Figure 1A:
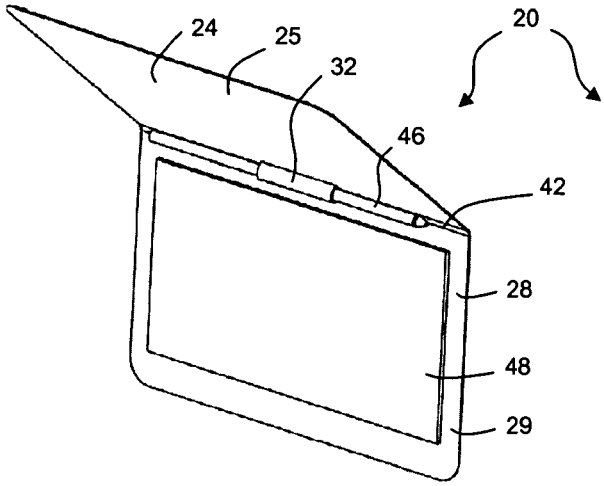
FIGS. 1A to 1H show a basic embodiment of the present invention, containing a single body with slits or cutouts and multiple fold lines which create a notepad holder and a writing instrument receptacle.

20 basic note device
22 preformed device body
24 top portion of device body
25 top inner surface
26 top outer surface
28 bottom portion of device body
29 bottom inner surface
30 bottom outer surface
32 instrument receptacle
33 separate material for receptacle
34 receptacle slits
35 receptacle cutouts
36 pull tab slit 1
37 pull tab slit 2
38 female closure slit
40 male closure slit
42 main hinge
43 pocket fold line
44 receptacle fold lines
45 pocket
46 writing instrument
47 comfort nub
48 note paper
49 air hole
50 note device with closure
52 pre-formed device body with closure
54 closure tab
56 device pull tab 1
57 device pull tab 2
58 single tab grip
59 wallet
60 credit card slot
61 note device with dual hinge and pull tabs
62 pre-formed device body with dual hinge and pull tabs
63 upper main hinge
64 lower main hinge
65 pull tab 2 hinge
66 dual tab grip
67 molded dual tab grip
68 tab grip notch
69 triple tab grip
71 adhesive
72 strip of material
70 finger loop grip
73 hand
74 standard pen
76 note device with interlocking loop closure
78 upper body loop
80 lower body loop
82 note device with business card holder
84 business card
86 card holder tab
88 card holder slits

DETAILED DESCRIPTION

Figure 1B:
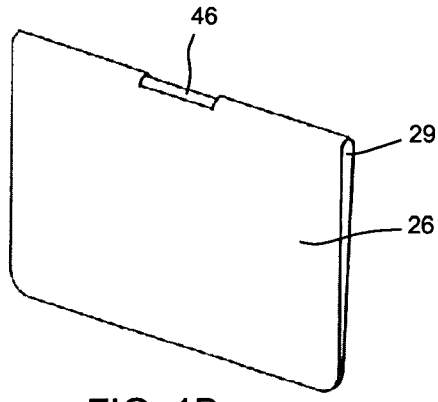
Figure 1C:
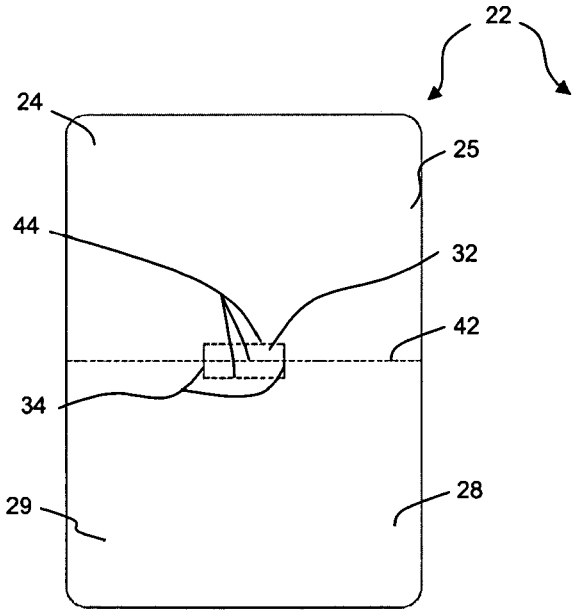
Figure 1D:
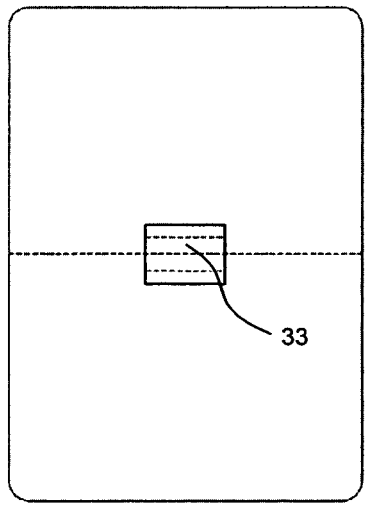

FIGS. 1A-1C:

In accordance with an embodiment of the invention, a device body 22 is made of a single sheet material (e.g., paper or thin plastic), as shown in its pre-formed state in FIG. 1C. The body 22 preferably is generally rectangular with a lateral fold line 42 (approximately across the center) that separates a top portion 24 from a bottom portion 28 of the device, with each portion having a respective inner surface (25, 29) and outer surface (26, 30). In accordance with a preferred embodiment, when the device is folded, and thus in a closed position, (FIG. 1B), it is approximately the size of a credit card (about 3⅜"×2⅛"). The term "generally rectangular", as used herein, is meant to encompass a body that includes one or more rounded corner, as shown, e.g., in the FIGS. 1C and 1H, as well a body where opposing edges are generally parallel to one another, but need not be exactly parallel.

Two slits 34 are formed across the main fold line 42, which is the device hinge. In accordance with an embodiment, the two slits 34 are generally parallel to one another and perpendicular to the device hinge 42. These slits 34 are made across the fold line such that when the top and bottom portions of the body, 24 and 28, are folded together, and the slit region 32 is urged into the encased region (in a direction opposite the hinge 42), three additional fold lines 44 are created between the slits. The region or portion 32 between the slits then becomes a receptacle for holding such articles as writing instruments, toothpicks, and any other relatively thin and elongated member, as shown, e.g., in FIG. 1A. The slits 34 may also be other than a straight line, provided the end points of each slit crosses the main hinge line, as shown with two curves, e.g., in FIG. 1E. A minimum of two slits is required to create one receptacle; however, multiple receptacles can be created with multiple pairs of slits if so desired. For instance, two shorter receptacles separated by a distance may be created rather than one long receptacle. The multiple receptacles can be used for holding more than one article, or for holding a single article at more than one location along the article.

Figures 1E, 1F:
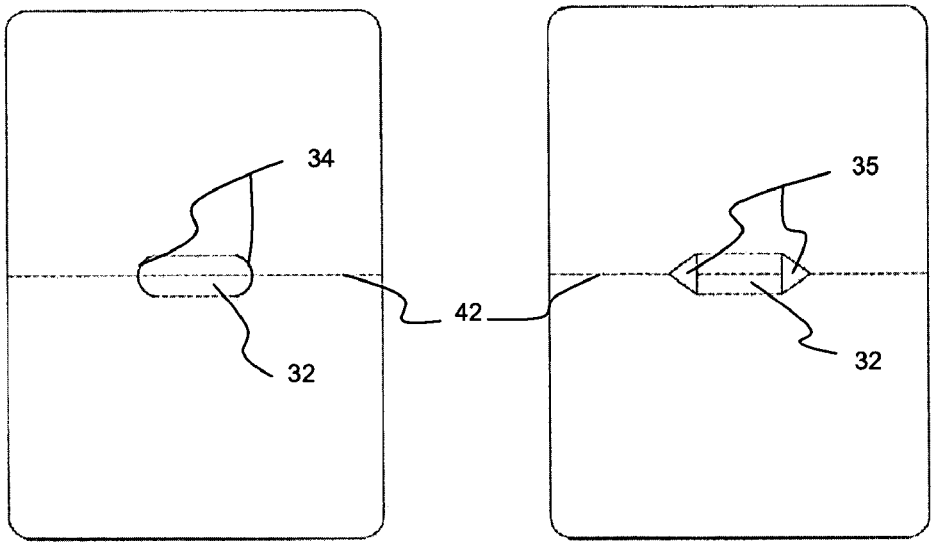
Figures 1G, 1H:
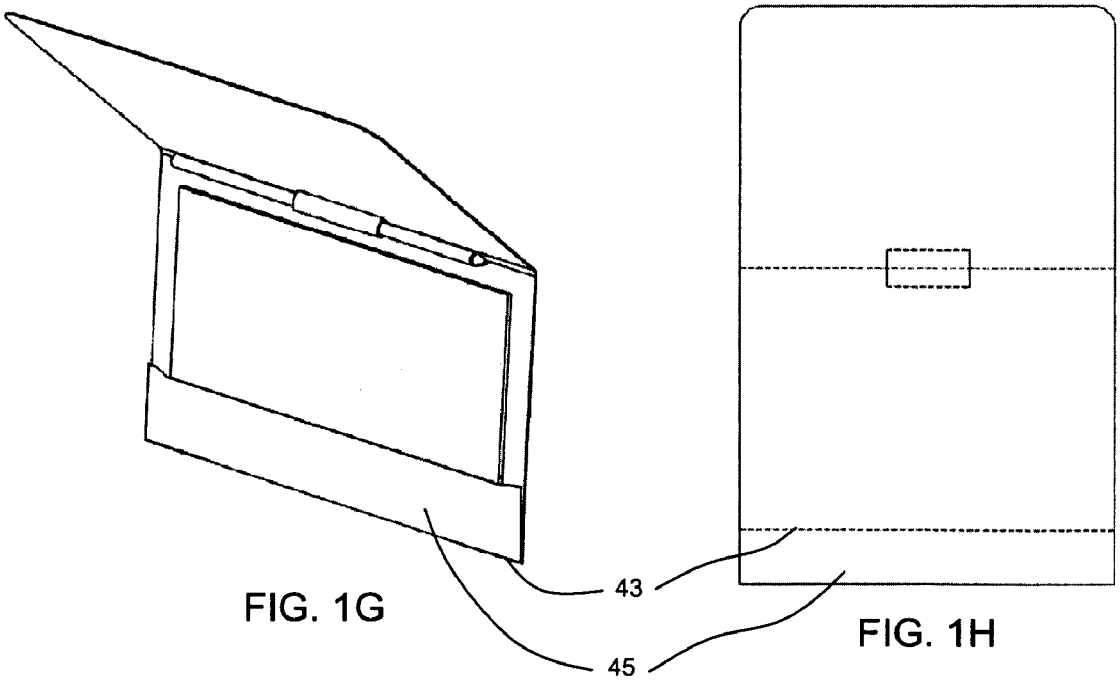

Alternatively, as shown in FIG. 1F, two small sections 35 (i.e., cutouts 35) may be cut out to form the receptacle region 32, provided the cut crosses the main hinge line. Two advantages to the triangular cutouts 35 shown are 1) easier insertion of elongated member due to the tapered holes and 2) easier visual recognition of the receptacle ends. It is also possible to form the receptacle region 32 between a slit 34 and a cutout 35.

In an alternative embodiment, it is also possible to affix a separate piece of material 33 to the body 22 to obtain a similar shaped receptacle feature, as shown in FIG. 1D. However, such an embodiment is less cost effective from both a material and manufacturing standpoint.

Referring again to FIG. 1A, the formed device 20 may be equipped with a notepad 48 on the bottom inner surface 29. It may also be positioned on the top inner surface 25. In accordance with an embodiment, the notepad is generally rectangular in order to maximize the writing area. Various types of notepads may be used, including pressure-sensitive adhesive notes, glue-top notes, and perforated notes. The notepad can be affixed directly to the device body by several methods, including permanent adhesive, pressure-sensitive adhesive, heat bonding, stapling, etc. In accordance with a specific embodiment, the device body could have an extra fold line 43 which creates an integrated pocket 45 (see FIGS. 1G and 1H) to hold notes or other flat items. Since the device may be manufactured cheaply and sold to consumers inexpensively, it is also feasible that no note papers are attached, and the user writes directly on a surface (e.g., surface 25 and/or 29) of the device.

The formed device may also be equipped with a writing instrument 46, which can be secured in the formed receptacle 32. The writing instrument 46 is generally elongated and preferably cylindrical (and preferably no greater than approximately 0.125" in diameter), and its axis resides alongside the main hinge line 42 of the device. The total length of the instrument 46 preferably does not exceed the length of the device along the main hinge line so it remains protected within the device. In the case of a pencil or ball point pen without a cap, the tip should be positioned within the device to prevent the tip from possibly contacting an external surface and inadvertently writing on it. The instrument is preferably thin enough such that the device with the instrument therein is easy to carry in small places like a wallet, pocket, or purse. However, during the act of writing, it is desirable that the instrument is also comfortable. These two comments will be discussed in further detail below.

The top outer surface 26 (FIG. 1B) and bottom outer surface 30 (FIG. 3B) preferably have large areas for containing graphics such as artwork, company logos, comics, cartoon characters, photographs, calendars, business card information, etc. To efficiently and cost effectively accommodate high volumes in manufacturing, these graphics can be printed directly on the material before the cutting and slitting operations occur. This can be done inexpensively through existing printing processes. In contrast, smaller volumes may be assembled with graphics printed on adhesive-backed paper. The outer surfaces may also be sold blank so that the user can customize the cover himself. For example, children may draw on it or add stickers of their choice. The top inner surface 25 (FIG. 1A) also has a large area for containing graphics, for which the previous statements apply. In the scenario in which one desires to save a used note from the notepad, this area may also be used as a note storage area (assuming the notes have pressure-sensitive adhesive backing). The bottom inner surface 29 (FIG. 1A) may mostly be obstructed by a notepad. However, graphics may still be printed on this surface.

In the embodiment shown in FIG. 1A, the receptacle 32 created at the hinge line 42 of the device body leaves a discontinuity or void of material in the body. This is evident when viewing the device in the closed position (FIG. 1B), in which a portion of the writing instrument 46 is visible. This void in material provides the user with the ability to quickly verify the presence of the instrument, and it also provides the manufacturer with a viewable region to imprint a small graphic or text on the instrument in that region.

The closed device 20 (FIG. 1B) is preferably thin enough that it can comfortably be carried in a pocket, a purse, and even a wallet. Accordingly, the writing instrument should not be so large that the overall device becomes burdensome in the aforementioned locations. Likewise, the amount of note paper stored within should not be excessive. In accordance with an embodiment, the total thickness of the closed device should generally not exceed 0.150" in the notepad region when considering this device for storage in the wallet, as this is approximately the thickness of 3 credit cards back-to-back.

Figure 2A:
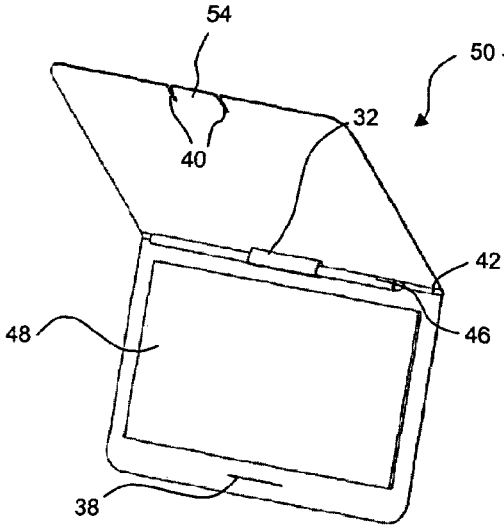
FIGS. 2A to 2C show a further embodiment of the present invention, containing a single body with multiple slits or cutouts and fold lines which create a notepad holder, a writing instrument receptacle, and a closure mechanism.

FIGS. 2A-2C:

The embodiment of the present invention shown in FIG. 2A is similar to that of FIG. 1A, except that the preformed body 50 has additional slits 38 and 40.

A closure mechanism is desirable in order to keep the device as slim and organized as possible, especially when the device is being carried loosely within a pocket or bag. A closed device will also apply more pressure around the writing instrument, thus increasing the coefficient of friction and preventing the instrument from inadvertently sliding out of the device. Without a closure method, top and bottom portions of an unused device may tend to open up due to the writing instrument placed closely to the hinge line, the stack of note papers, and the inherent elastic properties of the body.

Figure 2B:
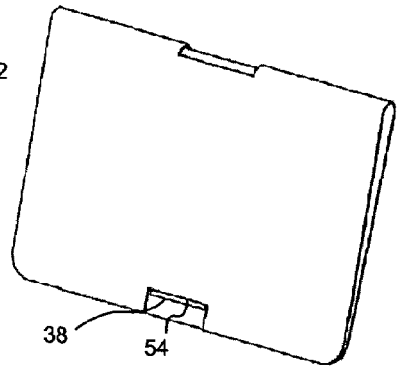
Figure 2C:
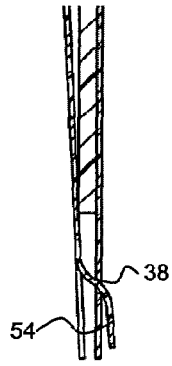

Referring to FIGS. 2A-2C, in this embodiment, a male tab 54 is inserted into slit 38 to keep the device in a closed orientation (FIG. 2B) when so desired. A cross-section of this closure feature is shown in FIG. 2C. The male tab is created by two slits 40 in the upper portion of the body, generally perpendicular to the main hinge line 42, but preferably slightly angled such that the tab is trapezoidal in shape with the short base on the outer edge of the body and the long base as the tab's pivot point. In accordance with an embodiment, the width of the tab 54 (or distance between slits) is about 0.6" to 1", and the height of the tab (perpendicular from trapezoidal base to base) is about 0.15" to 0.40". The tab is preferably large enough to use easily but not so large that it detracts from the aesthetics of the device. In accordance with an embodiment, slit 38 is generally parallel to the main hinge line 42 and located on the lower portion of the body such that the male tab 54 aligns appropriately and can be easily inserted. The length of the closure slit should be equal to or greater than the width of the male tab. Positioning the slit too close to the edge will result in weak points in the body which may tear, and positioning it too far from the edge will detract from the amount of useable note space within the device. In accordance with an embodiment, the closure slit is positioned about 0.15" to 0.40" from the bottom edge of the body.

Figure 3A:
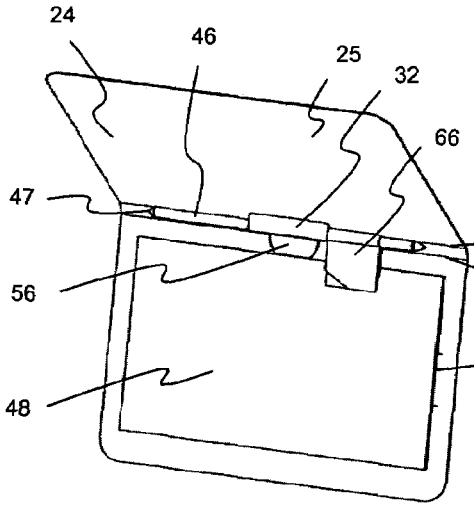
FIGS. 3A to 3C show a further embodiment of the present invention, containing a single body with multiple slits or cutouts and fold lines which create a notepad holder, a writing instrument receptacle, two device pull tabs, and a writing instrument with dual grip tab.

FIGS. 3A-3E:

The embodiment of the present invention shown in FIG. 3A is similar to that of FIG. 1A, except that the pre-formed body 62 has additional slits 36 and 37 and two main hinge fold lines 63 and 64.

Figure 3B:
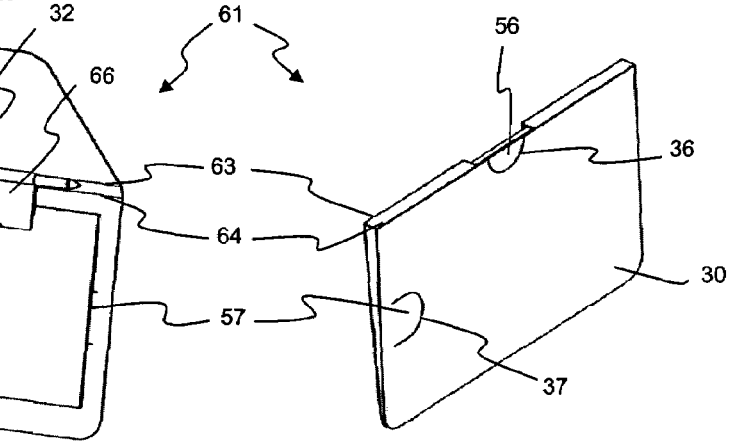

To decrease the resistance of the body to closing due to interference with the instrument, the main hinge section of the body may be formed with two fold lines, 63 and 64, such that the inner surface of the formed body does not contact the outer surface of the writing instrument when the device is closed (FIG. 3B). Since the top portion 24 no longer contacts the instrument in the closed position and the resistance to closure is minimized, there is less need for an additional closure mechanism. The aforementioned details of creating the instrument receptacle 32 apply to this embodiment, provided the slits or cut-outs cross one or both fold lines 63 and 64.

In specific embodiments, the device also contains a writing instrument which has a minimum of one thin tab protruding radially from the shaft. FIG. 3A shows the preferred embodiment of the dual tab grip 66. The tab grip performs three functional tasks: it provides an axial stop for the instrument such that it can be repeatedly placed in the same position within the holder (preventing instrument protrusion from the device); it allows the user to easily insert and remove the instrument from the receptacle, whereas this action might otherwise be awkward with a small elongate object; and it also provides the user with additional surface area with which to grip the instrument during writing. This tab feature can be made in a variety of ways, including: it is injection molded as part of the instrument body, either as a single shot or overmolded; a separate injection molded part is adhered, pressed, or heat bonded to the shaft of the instrument; extruded plastic is adhered, pressed, or heat bonded to the shaft of the instrument; a thin sheet of material (e.g., paper or plastic) is folded and adhered or heat bonded to the shaft of the instrument. These processes may be used to create one or more tabs on a single instrument.

As shown in FIGS. 3B-3E, a slit 36 centered on the lower receptacle fold line 44 midway between the receptacle slits 34 (e.g., with a radius of about 0.25") creates a pull tab 56, which can be pivoted about its fold line 44. More specifically, in the embodiment shown in FIG. 3C, the pull tab 56 is formed by a continuous slit that starts at one of the fold lines 44, extends away from the fold line and into one of the top and bottom portions 24 and 28, and returns to the fold line 44 a distance apart from where the continuous slit starts. This tab can be used to remove the device from a narrow slot in which the device is stored, such as that from the credit card slot 60 of a wallet 59 (FIG. 3F) in which the slot is open lengthwise. If the device shares a credit card slot with one or more credit cards or the like, this pull tab is convenient for easily identifying and removing the device. The slit defining the tab need not be confined to a semi-circle on the receptacle fold line, as any continuous slit with endpoints which create a fold line generally parallel to the main hinge fold line 42 will work. For further examples the pull tab can be semi-oval, rectangular or triangular, but is not limited thereto. The fold line of the pull tab may be located anywhere on the top or bottom (preferably) portions 24 and 28 of the main body, as long as the resulting pull tab in its folded position extends beyond the perimeter of the closed device. For example, in one embodiment, the pull tab is formed by a continuous slit that starts at the main hinge 42, extends away from the main hinge and into one of the top and bottom portions 24 and 28, and returns to the main hinge 42 a distance apart from where the continuous slit starts.

Figure 3C:
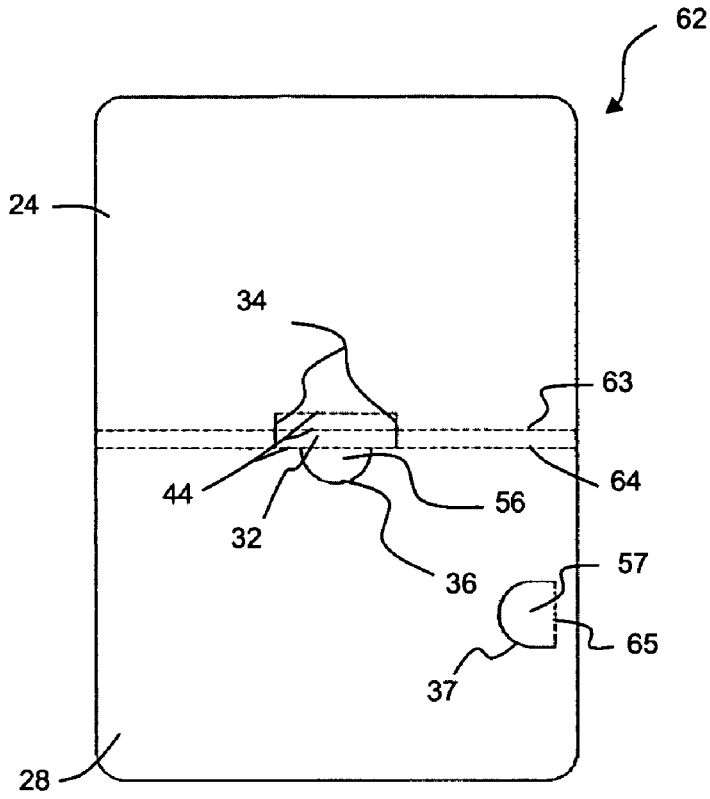
Figure 3D:
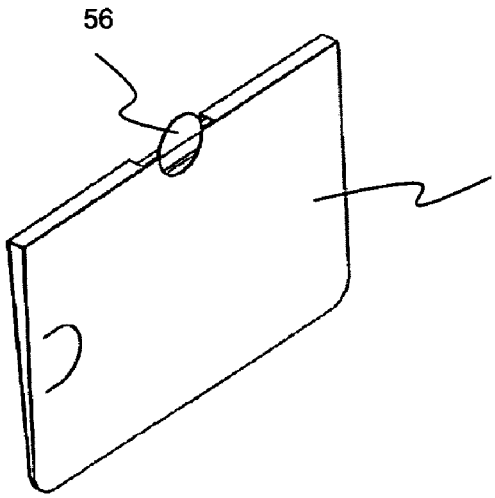
FIGS. 3D to 3G show the operation of the embodiment of FIGS. 3A to 3C, specifically the device pull tabs.
Figure 3E:
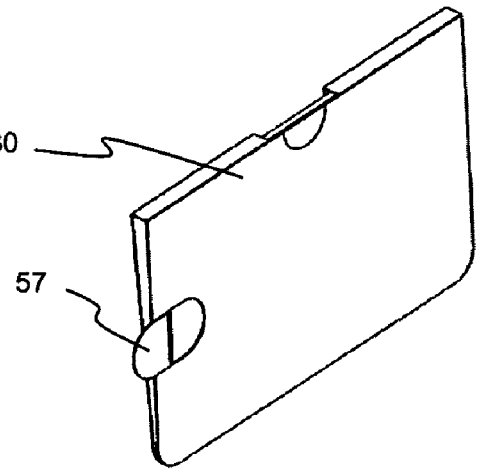
Figure 3F:
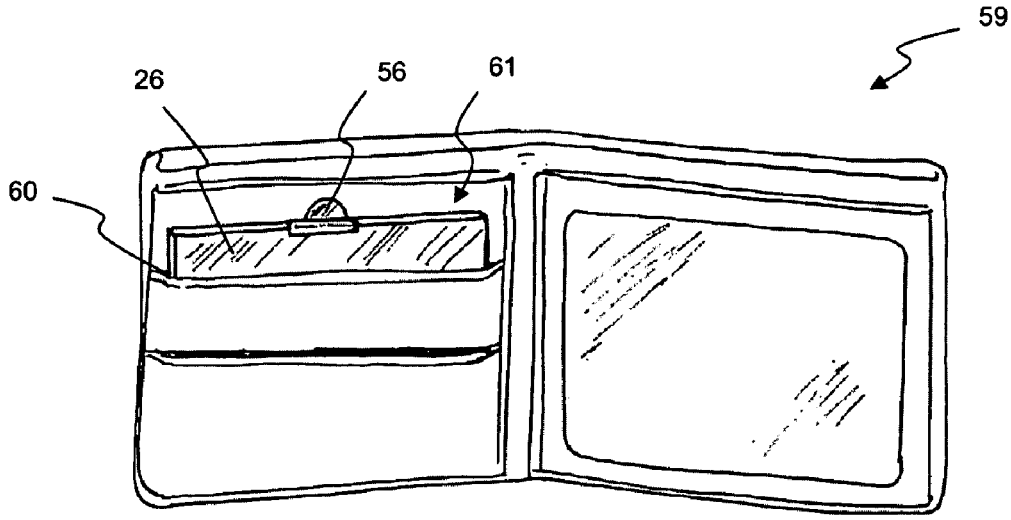
Figure 3G:
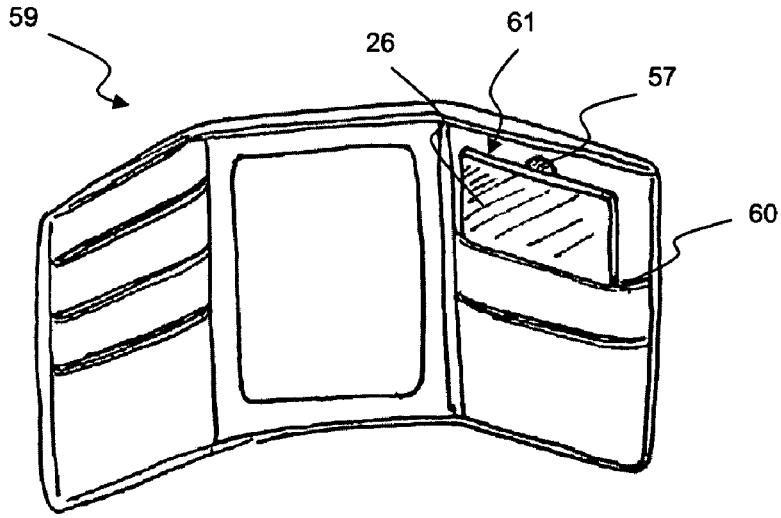

In the case of a wallet with a credit card slot 60 oriented widthwise (FIG. 3G), an additional pull tab 57 is created by slit 37 (FIGS. 3C and 3E). The tab is composed of a continuous slit whose beginning and end points create a hinge 65 perpendicular to the main hinge lines 63 and 64. The length of the tab is such that it protrudes beyond the envelope of the device when extended. Both tabs 56 and 57 can be perforated such that the user can pull out the appropriate tab corresponding to their wallet, or if the device is to be stored loosely in a purse or pocket, the user need not extend either tab.

In another embodiment (not specifically shown), the pull tab 57 can be formed directly from the die-cutting process, such that the tab 57 is not a slit in the body but rather a protrusion from the nominally rectangular body shape. This protrusion would eliminate the need for the user to fold out the tab because the tab is inherently extended beyond the device envelope, but it may cost more to manufacture due to extra scrap material. Further, where a credit card slot is oriented lengthwise (FIG. 3F), it may be necessary to fold over such a die-cut tab 57 to enable the device to fit within the slot.

Figure 3H:
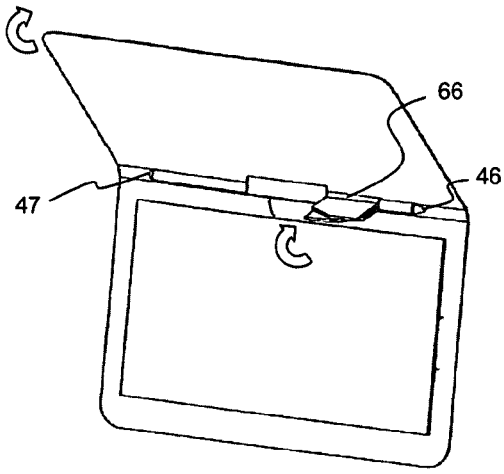
FIGS. 3H and 3J show the operation of the embodiment of FIGS. 3A to 3C, specifically removal of the writing instrument.
Figure 3J:
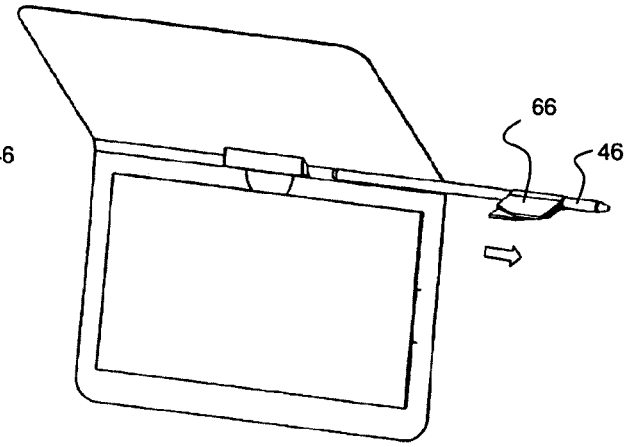

FIGS. 3H and 3J:

FIG. 3H shows that the dual tab grip 66 can be used to facilitate the removal of the writing instrument 46. With the device in the closed configuration, the tabs lie flat within, and generally parallel to, the notepad. Once the top portion of the body is lifted to open the device, the grip 66 is accessible. The user can rotate the grip upward such that it can be grasped easily (FIG. 3H), normally with index finger and opposing thumb. The instrument 46 can then be removed from the receptacle by simply sliding the gripping tab 66 and instrument unit 46 outward along the axis of the receptacle, as shown in FIG. 3J. Inserting the instrument into the device can be easily accomplished by reversing the aforementioned steps. The proximal, or non-writing, end of the instrument is rounded to allow easy insertion of the instrument into the receptacle. FIG. 3H shows the rounded end as a comfort nub 47 inserted into the end of the writing instrument. The nub may be injection molded or extruded and turned plastic. In the case of a ball point pen barrel, the nub has a small hole 49 through it allowing the passage of air into the ink chamber (FIG. 9B). This comfort nub 47 also provides benefits to the user during writing, as described in the following section.

Figure 4A:
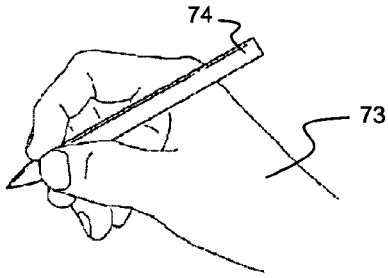
FIGS. 4A to 4B show the primary grip with a standard pen.
Figure 4B:
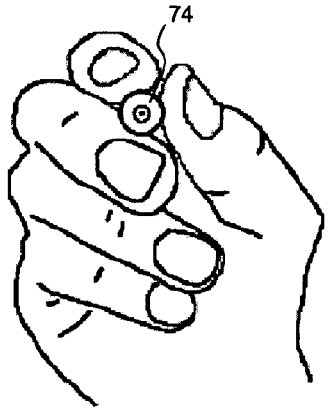

FIGS. 4A-9D:

The gripping technique for holding pens and pencils that is currently taught in most schools is known as the primary grip. This is done by relaxing the hand, joining the tips of the thumb and middle finger, laying the shaft of the instrument in the cleft between, and finally laying the index finger on top of the instrument. The resulting grip is depicted in FIGS. 4A (side view) and 4B (a view looking directly into the long axis of the instrument with a standard-sized pen 74). There are four main points of contact with this grip: one at each of the three digits, near the tip of the instrument, and one adjacent to the first knuckle of the index finger, where the mid-section the instrument typically resides.

Figure 5A:
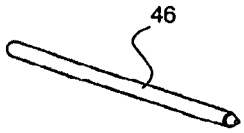
FIGS. 5A to 5B show a small diameter writing instrument and associated holding technique.
Figure 5B:
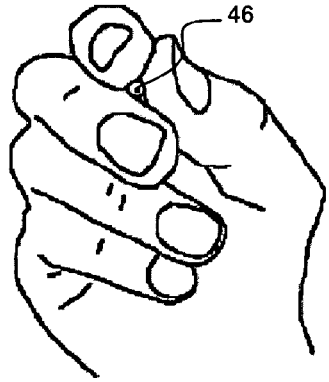

In the basic embodiment of FIG. 1A, a small diameter instrument 46 can be gripped using the primary grip (FIG. 5B). One's grasp on this straight shaft (FIG. 5A) is inherently less stable than that on a larger diameter shaft because the three digits are in contact with each other in addition to contacting the instrument. Some of the pressure is thereby distributed to the other fingers instead of the pen. In this embodiment, it is important that the shaft diameter is not too small, a minimum of about 0.090". Also, the shaft should be relatively stiff so it does not flex between the fingers and the proximal contact point in the users hand while he is writing. This flexure reduces comfort and control. Good material choices include extruded metal and rigid plastics. Extruded non-rigid plastic with stiffening ribs will also work. The shaft is preferably cylindrical, much like a regular pen or a regular pencil (made up a multiple flat surfaces that from a cylinder), and as just mentioned, due to its small diameter may include stiffening ribs or the like to increase the rigidity of the instrument 46.

Figure 6A:
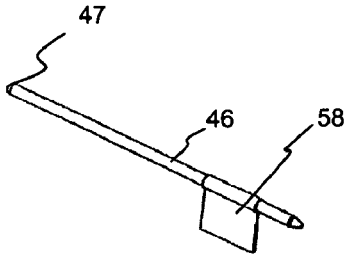
FIGS. 6A to 6D show a small diameter writing instrument with single tab grip and associated holding technique, according to an embodiment of the present invention.
Figure 6B:
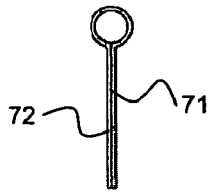

In the embodiment of FIG. 3A, the small diameter instrument 46 contains a grip with a minimum of one tab. As previously mentioned, the grip provides a stop during insertion; it allows easier instrument insertion into and removal from the device; and it also affords the user a better grasp on the instrument. As shown in FIG. 6A, the single tab 58 offers more surface area (compared to no tab) which the user can grasp typically between his thumb and index finger or between his thumb and middle finger (normally, little pressure is applied directly between the index and middle fingers). The tab 58 preferably protrudes radially at least ⅜th of an inch from the shaft of the writing instrument 46, to thereby provide a substantial surface area. The surface area of the tab transfers pressure from the fingers to the instrument, whereas with the same small diameter shaft and no tab, some of that pressure would be transferred to adjacent fingers. Thus, the diameter of the instrument with a tab grip 58 can be smaller than an instrument without one. Not only does the tab increase comfort and control, but it allows a smaller diameter instrument to be carried in the device, making the overall device more pocketable.

Figure 6C:
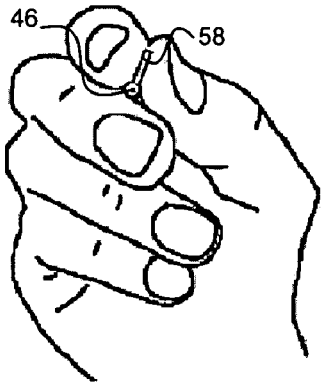
Figure 6D:
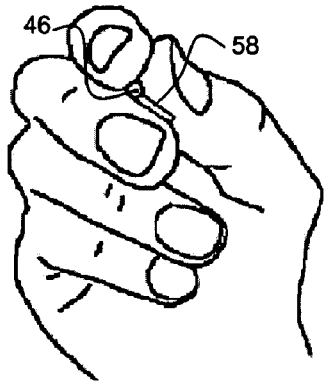
Figure 7A:
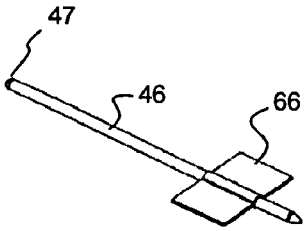
FIGS. 7A to 7G show a small diameter writing instrument with dual tab grip and associated holding technique, according to an embodiment of the present invention.
Figure 7B:
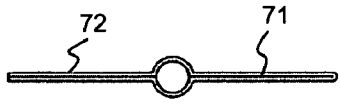
Figure 7C:
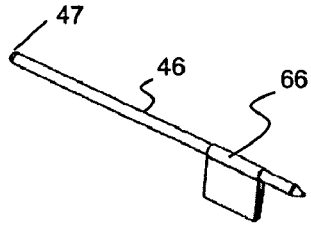
Figure 7D:
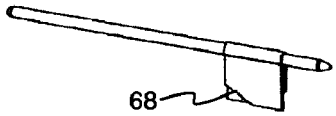
Figure 7E:
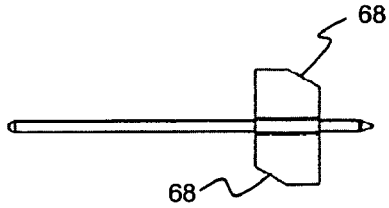
Figure 7F:
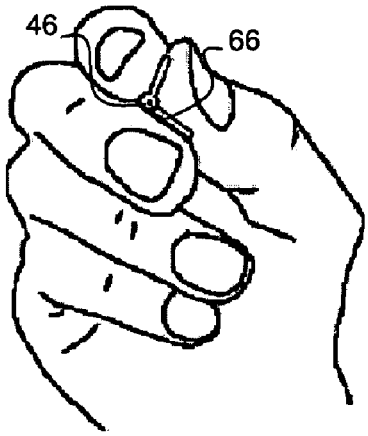
Figure 7G:
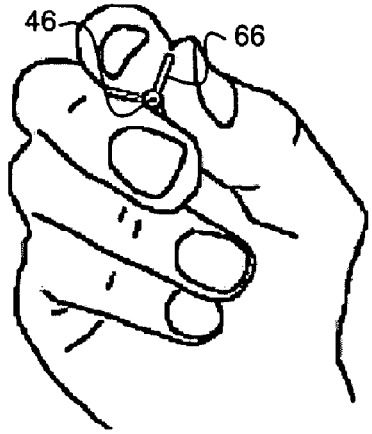

Similarly, the user can gain even more control of the instrument with a dual tab grip 66 as shown in FIG. 7A. More pressure is transferred from the fingers to the instrument via the enlarged surface area in contact with the digits and less finger-to-finger contact. As shown in FIGS. 7F and 7G, there are a variety of ways in which the instrument can be held: with tabs between the index finger and thumb and between the thumb and middle finger (FIG. 7F); with tabs between the middle and index fingers and between the index finger and thumb (FIG. 7G); both tabs can be folded together to resemble a single tab (FIG. 7C) so that grips of FIGS. 6C and 6D can also be used. The two tabs are flexible and conform to the desired grip. When the instrument is stored in the note device, the tabs can be folded together to aid in insertion (FIG. 7C), and once the instrument is in place, closing the device will naturally deflect and orient the tabs. In accordance with an embodiment, the dual tab grip can be made with a generally rectangular strip of adhesive-backed paper or plastic approximately 1.5" long by 0.5" wide by 0.004" to 0.010" thick; the strip is folded generally lengthwise in half; the inner surfaces are adhered together with the instrument positioned perpendicularly and centered therein. See FIG. 7B for an enlarged cross-sectional view. The dual tab grip may also be injection molded or extruded from plastic. The tabs may have living hinges, at the base of each tab, which allow for greater flexibility.

If the tabs remain folded (FIG. 7C) in the closed note holder device for an extended period of time, they may have a tendency to remain folded together when removed from the device. Tab notches 68, as shown in FIGS. 7D and 7E, allow the user to easily separate the tabs if so desired.

Figure 8A:
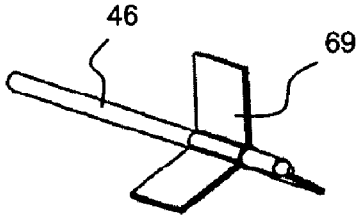
FIGS. 8A to 8D show a small diameter writing instrument with triple tab grip and associated holding technique, according to an embodiment of the present invention.
Figure 8B:
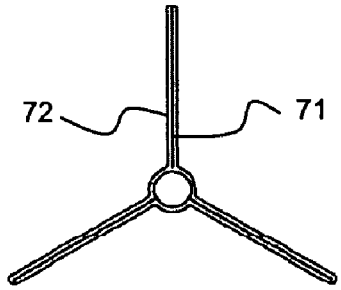
Figure 8C:
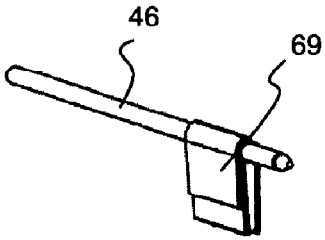
Figure 8D:
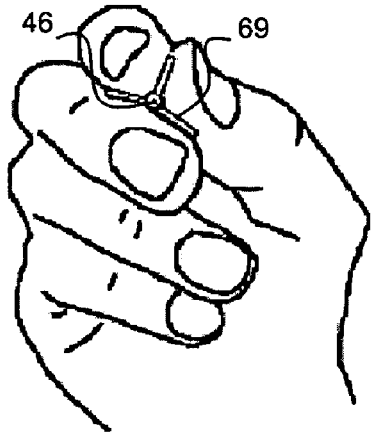

As shown in FIG. 8A, yet another tab can be added to create a triple tab grip 69. This grip provides surface area between each of the three digits involved in the primary grip, as seen in FIG. 8D, such that little or no contact is made between the digits, and the transfer of pressure from the hand to the instrument is most efficient. One of the tabs can be folded alongside the instrument axis such that it rests alongside a neighboring tab, allowing the grip to be held in any of the dual tab configurations (FIGS. 7F and 7G). Similarly, all three tabs can be folded together (FIG. 8C), allowing the grip to be held in any of the single tab configurations (FIGS. 6C and 6D); this is how the instrument would be stored in the note device. The triple tab grip may be the most comfortable and versatile grip, but there is a greater tendency for the tabs to open up, making it more difficult for the device to remain in the closed position. One method of manufacture is starting with a generally rectangular strip of adhesive-backed paper or plastic approximately 2.25" long by 0.5" wide by 0.004" to 0.010" thick; with the adhesive side facing up, the instrument is placed on top perpendicularly and centered; the two strip ends are folded back onto the main strip and on the instrument such that the two fold lines are each at about ⅓ the total length from the center—this completes two tabs; the final tab is created by two more fold lines where the remaining material meets at the instrument and the material is adhered together (FIG. 8B).

FIGS. 9A-9B:

Any of the small writing instruments mentioned above can be held with the primary grip such that the proximal end of the instrument contacts the area on the side of the hand adjacent to the first knuckle of the index finger knuckle, similar to the grip in FIG. 4A. In order to better facilitate this grip, the shaft of the instrument may be composed of two or more concentric tubes which telescope to provide a longer effective shaft, in accordance with an embodiment of the present invention.

Figure 9A:
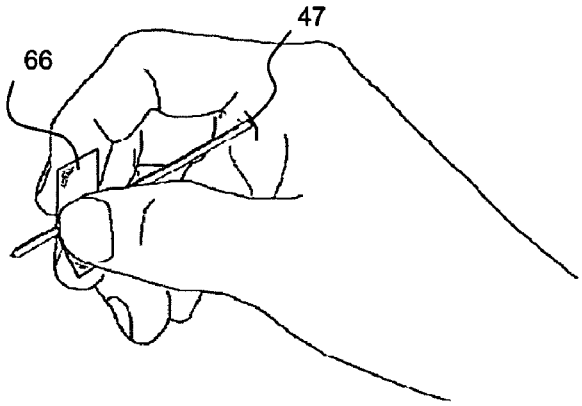
FIGS. 9A to 9B show an alternate gripping method with comfort nub.
Figure 9B:
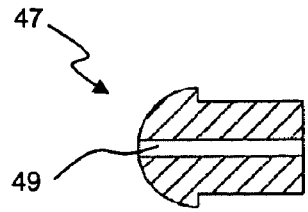

The instrument can also be held such that the proximal tip of the shaft rests inside the hand, pressing axially along the length of the shaft against the hand just underneath the index finger, as shown in FIG. 9A (shown with dual tab grip). This technique of holding provides an additional element of stability. This proximal end may be treated such that it is more comfortable when held in this position. In an embodiment of FIG. 3A, the instrument contains a comfort nub 47 (FIG. 9B), a soft plastic plug which is rounded and smooth. Additional treatments include attaching a soft and/or elastic material such as rubber or felt and enlarging the surface area to distribute the force to the hand.

Figure 10A:
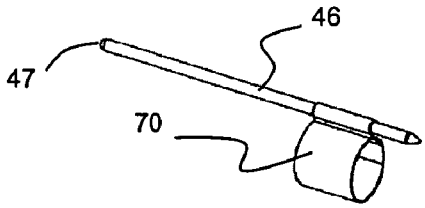
FIGS. 10A to 10D show a small diameter writing instrument with a finger loop grip and associated holding technique.
Figure 10B:
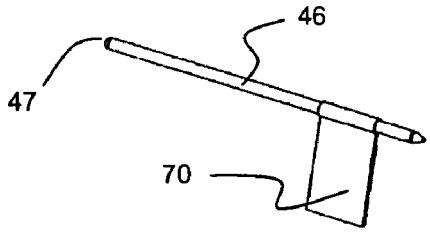
Figure 10C:
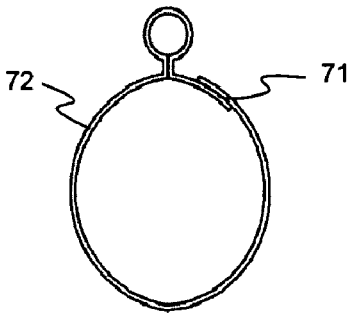
Figure 10D:
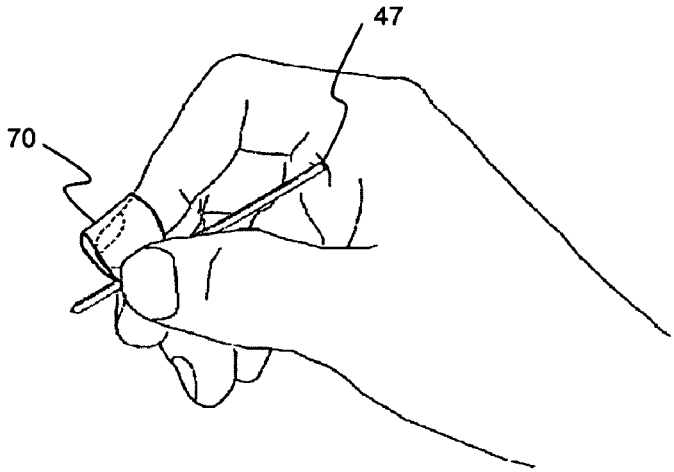

FIGS. 10A-10C:

As shown in FIG. 10A, another type of grip can be made that includes a loop of material 70 inside which a finger is inserted. FIG. 10D shows the holding technique with the index finger within the loop. This loop 70 provides additional writing control to the user by increasing contact surface area between the instrument and fingers as well as by securely fitting the loop onto the finger, which decreases the squeezing force required by the remaining fingers. FIG. 10C shows a cross section of the loop 70 as made by a single strip of material. FIG. 10B shows the loop flattened such that it can be compactly stored in the note holder.

FIGS. 11A-11C:

In accordance with embodiment of the present invention, alternative types of closure mechanisms are used. These include variations of the male tab and slit configuration (FIG. 2A). Additionally, a matchbook style closure (not shown) would work—a narrow section of the bottom portion of the device is folded inward and stapled or adhered such that the top portion of the device can be inserted and held in the gap created. Another closure mechanism is achieved by applying a pressure-sensitive adhesive to the inner top and/or bottom portion of the body near the periphery.

Figure 11A:
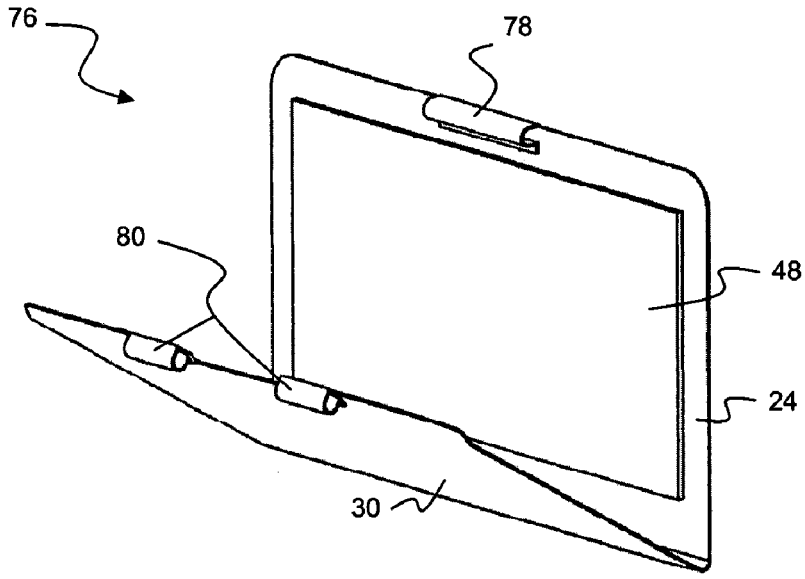
FIGS. 11A to 11C show another embodiment of the present invention, which contains a device closure including collinear loops interlocking with the writing instrument.
Figure 11B:
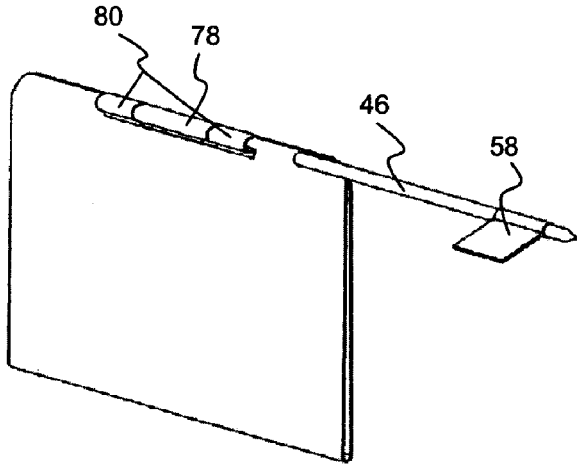
Figure 11C:
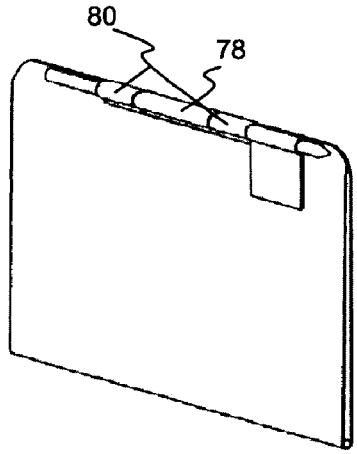

FIGS. 11A-11C illustrate yet another closure. This one uses the writing instrument as a lock which holds the top and bottom portions together. A loop 78 is created at the top edge of the body by folding and adhering an extended tab. One or more loops 80 are created in a similar manner at the opposing edge of the body. The device open position is shown in FIG. 11A. When the top and bottom portions of the body are brought together to close the device, the loops 78 and 80 become collinear (FIG. 11B). A writing instrument 46 can be inserted through the loops such that the writing instrument prevents separation of the loops from the instrument axis (FIG. 11C).

Figure 12A:
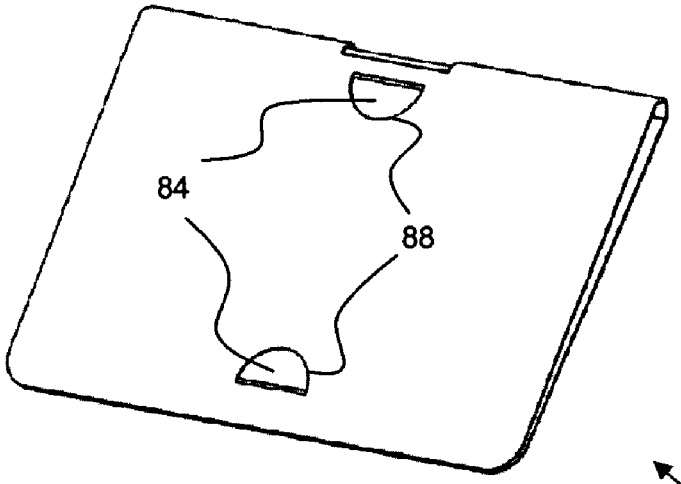
FIGS. 12A to 12B show still another embodiment of the present invention, containing a holder for flat objects like business cards.
Figure 12B:
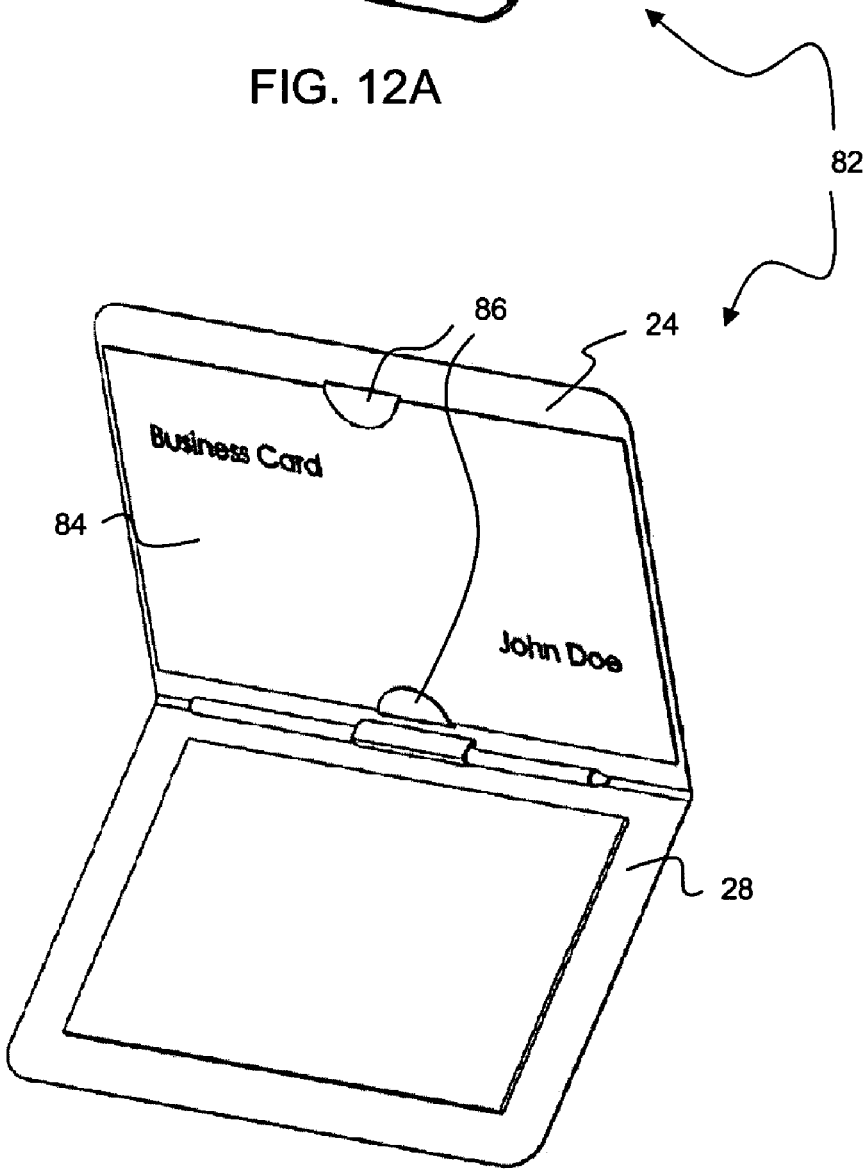

FIGS. 12A-12B:

In another embodiment, the device in FIG. 12A is similar to FIG. 1A but contains features which allow the device to hold additional flat items within, such as a business card 84 (FIG. 12B). To accommodate a business card, the body is slightly wider and longer than that of FIG. 1C since business cards are typically longer than credit cards. The standard card measures 3.5" by 2", so the closed device would measure approximately 3.6" by 2.5". The business card can also be held on an exterior surface of the device. The card is held in place by tabs created 86 from two semi-circular slits 88, about 0.25" radius, in the upper portion of the body 24. The slits are oriented such that they are generally centered laterally within the device, and the tabs created oppose each other in a direction along the length of the preformed body. The distance between the tabs is slightly longer than the narrow dimension of the object being held—for a business card, about 2.1". The tabs can be lifted out of the plane of the body toward the inner or outer surface of the top portion of the body such that the object can be inserted between the tabs and the surface of the body. The tabs do not need to be semi-circular in shape since many shapes will work, provided that there is sufficient overlap of the tabs onto the held object and there is sufficient material adjoining the tab and body for adequate stiffness. There may also be more than two tabs used to secure the object.

A generally rectangular object can also be held by slits made in the device body at two diagonal corners of the object. One set of diagonal corners of a business card can slide through the slits. Additional slits at the remaining corners may be made for a more secure fit. In this embodiment the body of the device should be larger to accommodate the slits and extra material which prevents the slits from tearing through to the body edge.

From the description above, a number of advantages of the aforementioned note devices become evident:

a) The main body, which may contain a notepad and writing instrument and may have additional features for closure and holding other items such as business cards, may be made of a single part.

b) The main body is simple, cheap, and easy to manufacture.

c) There is ample room for graphics on all surfaces, which can be applied inexpensively through existing printing processes. The device can be graphically treated such that it resembles more of an accessory than it does a standard office supply.

d) The device can fit easily into a pocket, purse, and even the credit card slot in a wallet. The integrated pull tabs allow the device to be easily identified and removed from a wallet.

e) The device is simple and intuitive to use.

f) The writing instrument is small enough to fit easily into tight spaces such as a wallet, yet the gripping tab features allow the user to have a comfortable writing experience.

g) The main body can be made completely of recyclable and renewable materials (i.e. paper).

Although the description above contains many specifications, these should not be construed as limiting the scope of the invention but as merely providing illustrations of some of the presently preferred embodiments of this invention. It should be apparent to those skilled in the art that my invention may be modified in arrangement and detail without departing from the principles outlined. I claim as my invention all such modifications as come within the true spirit and scope of the following claims.

What is claimed is:

1. A writing instrument, comprising:

a main shaft having a first axial end with an orifice and a second axial end opposite said first axial end, and a length between said first and second axial ends;

a writing tip extending outwardly and axially from said orifice of said first axial end of said main shaft;

a chamber within said main shaft to supply writing material to said writing tip; and first and second tabs each protruding radially from a location along said main shaft between said first and second axial ends such that said first tab is graspable between a thumb and index finger of a user, while said second tab is graspable between the thumb and middle finger of the user or between the middle finger and index finger of the user;

wherein a diameter of said main shaft is not greater than 0.125 inches, and said length of said main shaft does not exceed a length of a standard credit card, thereby enabling the writing instrument to fit into a credit card slot of a wallet;

wherein each said tab includes two surfaces with a thickness therebetween;

wherein said thickness of each said tab is less than a diameter of said main shaft;

wherein said first and second tabs are foldable toward one another such that a said surface of said first tab and a said surface of said second tab face one another, and such that a collective thickness of said first and second tabs when folded toward one another is less than said diameter of said main shaft;

wherein said location along said main shaft, from which said first and second tabs protrude, is closer to said writing tip than to said second axial end; and wherein a distance from said location along said main shaft, from which said first and second tabs protrude, to said second axial end of said main shaft is such that said second axial end of said main shaft is restable against an inside of the user's hand while the user grasps said first and second tabs, thereby enabling the user to stabilize and provide axial pressure to said main shaft using the inside of their hand while writing.

2. The writing instrument of claim 1, wherein said first and second tabs are generally the same size.

3. The writing instrument of claim 2, wherein at least one of said first and second tabs includes a notch that is useful for separating said first and second tabs from one another after they have been folded toward one another.

4. The writing instrument of claim 1, wherein said first and second tabs are each generally planar.

5. The writing instrument of claim 1 , wherein said first and second tabs comprise a flexible material so that they conform to a user's grip.

6. The writing instrument of claim 1, wherein said second axial end of said main shaft is rounded to provide a comfortable anchor against a palm of a user.

7. The writing instrument of claim 1, further comprising:

a rounded soft nub that extends axially from said second axial end of said main shaft to provide a comfortable anchor against a palm of a user.

8. The writing instrument of claim 1, wherein said main shaft includes two concentric tubes that telescope to adjust a length of said main shaft.

9. The writing instrument of claim 8, wherein said concentric tubes telescope such that said length of said main shaft can be adjusted between a length that is less than the length of a credit card to a length that is greater than the length of a credit card.

10. The writing instrument of claim 1, further comprising:

a third tab extending axially from said main shaft such that said third tab is graspable between the middle finger and index finger of the user while said first tab is grasped between the thumb and index finger of the user and said second tab is grasped between the thumb and middle finger of the user.

11. The writing instrument of claim 10, wherein said first, second and third tabs are foldable toward one another such that a collective thickness of said first, second and third tabs is less than a diameter of said main shaft.

12. The writing instrument of claim 1, wherein said main shaft is generally cylindrical.

13. The writing instrument of claim 1, wherein said writing tip comprises a pen tip extending outwardly and axially from said orifice.

14. The writing instrument of claim 13, wherein said writing material that said chamber supplies to said writing tip comprises ink.

15. The writing instrument of claim 1, wherein said writing tip comprises a pencil tip extending outwardly and axially from said orifice.

16. The writing instrument of claim 15, wherein said writing material that said chamber supplies to said writing tip comprises a stick of pigment.

* * * * *

UNITED STATES PATENT AND TRADEMARK OFFICE

CERTIFICATE OF CORRECTION

PATENT NO. : 7,316,516 B2
APPLICATION NO. : 11/120021
DATED : January 8, 2008
INVENTOR(S) : Alan C. Regala It is certified that error appears in the above-identified patent and that said Letters Patent is hereby corrected as shown below:

In Claim 11, at Column 13, Line 14, replace “a” with --said--.

Signed and Sealed this

Thirteenth Day of May, 2008

JON W. DUDAS
*Director of the United States Patent and Trademark Office*